US006345999B1

(12) United States Patent
Okuyama et al.

(10) Patent No.: US 6,345,999 B1
(45) Date of Patent: Feb. 12, 2002

(54) CONNECTOR AND ELECTRONIC COMPONENT

(75) Inventors: Takeshi Okuyama; Hideo Miyazawa, both of Shinagawa (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/706,855

(22) Filed: Nov. 7, 2000

(30) Foreign Application Priority Data

Jan. 20, 2000 (JP) ..... 2000-011964

(51) Int. Cl.[7] ..... H01R 11/22
(52) U.S. Cl. ..... 439/268
(58) Field of Search ..... 439/268, 260, 439/259, 261–266, 269, 270

(56) References Cited

U.S. PATENT DOCUMENTS 4,179,178 A * 12/1979 Bachman ..... 339/111
4,720,156 A * 1/1988 Beers ..... 439/260
4,889,499 A * 12/1989 Sochor ..... 439/268
5,800,194 A * 9/1998 Yamagishi ..... 439/266
6,036,519 A * 3/2000 Lopata et al. ..... 439/260
6,042,409 A * 3/2000 Ohshima ..... 439/268
6,050,836 A * 4/2000 Tohyama ..... 439/260
6,149,449 A * 11/2000 Abe ..... 439/268

* cited by examiner

*Primary Examiner*—Gary Paumen
*Assistant Examiner*—Phuongchi Nguyen
(74) *Attorney, Agent, or Firm*—Staas & Halsey LLP

(57) ABSTRACT

A connector and an electronic component not damaged by connections to the connector are provided. The connector includes a pair of contacts attached to a base of the case, and an actuator. The actuator includes two slat members laid on one top of the other. Free ends of the pair of contacts are positioned in contact holes of the slat members. The contacts initially stand upright before an operation of the actuator. When the slat members are slid in opposite directions, the free ends of the contacts move further apart. After inserting the substrate terminal of the electronic component in between the free ends and releasing the actuator, the contacts try to resume their initial position because of their flexibility, and, as a result, securely hold the terminal.

12 Claims, 7 Drawing Sheets

CONNECTOR AND ELECTRONIC COMPONENT

BACKGROUND OF THE INVENTION

1. Field of the Invention

The present invention generally relates to connectors and electronic components connectable to the connectors, and particularly relates to a connector and an electronic component connectable to the connector not damaged by repeated connections and disconnections therebetween.

2. Description of the Related Art

To efficiently transmit a large quantity of signals, rapid signal transmission and high-density mounting of electronic devices are becoming increasingly demanded in recent years. Associated with this trend, miniaturization and multipolarization of connectors are progressing.

To meet the above-mentioned demands, a conventional connector is arranged with electronic contacts (terminals) into which pillar-type signal pins (terminals) are inserted in the axis direction. The contacts are equipped with contact areas that compress the outside edges of the signal pins in the diameter direction. In this case, the contact pressure of each connector can be decreased. However, as the number of the signal pins increases, an increased amount of force is needed for installing and removing the connectors as a whole, thus making installation and removal of the connector difficult.

There is also a possibility that the connector itself may be damaged or a contacted electronic component such as an LSI device may be damaged during connector installation or removal. Therefore, it is required to substantially eliminate the force necessary for installing and removing the connector.

A connector shown in FIG. 1 is conventionally used to reduce the force required for connector installation and removal.

The connector 1 is made up of a base 3 including contacts 2, an actuator 4 and a cover 5.

The base 3 has the plurality of the contacts 2 supported in a cantilever formation. The actuator 4 has contact holes 4*a* into which free ends of contacts 2 are fitted. In addition, the actuator 4 includes a pair of slidable members, which can slide on the base 3 in lateral directions as indicated by the arrows. The cover 5 has an opening 5*a*, which guides the outside edge of an LSI device 6, and holds the actuator 4 slidably.

When pushed portions 4*b* of the actuator 4 are pressed in the directions indicated by the arrows in FIG. 1 to move the pair of slidable members of the actuator 4 closer to each other, the free ends of the contacts 2 fitted in the contact holes 4*a* of each member of the actuator 4 are pressed against a wall 4*c* defined by the contact holes 4*a* and move to dotted-lined positions in FIG. 1 from the regular positions. When the LSI device 6 is installed in the connector 1 in a such condition, signal pins 6*a* of the LSI device 6 fit into the connector 1 with little required force without rubbing against the contacts 2. The contacts 2 resume their regular positions when the pushed portions 4*b* are released, and the contacts 2 contact the signal pins 6*a*. Therefore the connector 1 and the LSI device 6 are electrically connected.

However, the conventional connector 1 is insufficient in providing a constant and stable electrical connection since each contact 2 is pressed against only one side of the signal pin 6*a* of the LSI device 6. Even if the form and the material of the contact 2 are redesigned in order to increase contact pressure to stabilize the connection, there is a possibility of damaging the signal pins 6*a* of the LSI device 6 and the contact 2 itself of the connector 1 after repeating the connector installing and removing.

In general, with signal transmission, unbalanced transmission is widely adopted from a viewpoint of cost saving. However, due to the increasing trends of rapid signal transmission and high-density mounting of electronic devices, unbalanced transmission is likely to be affected by noise, particularly when rapid signal transmission is adopted. Therefore, there is a tendency to adopt balanced transmission. In this case, the conventional connector easily realizes the rapid signal transmission, but due to the structural characteristic of the connectors requiring two signal pins, the high-density mounting is sacrificed.

Typically, on a substrate of an electronic device, a common-use earth contact is provided besides a large quantity of signal pins. However, when each signal pin is arranged extremely close to one another to cope with the demands for the rapid signal transmission and high-density mounting of the electronic device, the connector tends to be influenced by noise. To solve the above-mentioned problem, a pair of an earth contact and a signal pin is introduced, but in this case, the high-density mounting of the electronic device is likely to be affected.

SUMMARY OF THE INVENTION

Accordingly, it is a general object of the present invention to provide a connector and an electronic component connectable to the connectors, which can solve the problems described above.

It is another and more specific object of the present invention to provide a connector and an electronic component connectable the connector not damaged by repeated connections and disconnections therebetween.

The connector of the present invention includes at least one pair of adjacent contacts having flexible free ends, arranged so as to face each other, wherein the least one pair of the adjacent contacts holds a terminal of connected electronic component so as to form an electrical connection to the electronic component.

The present invention enables high-density mounting of electronic devices for rapid signal transmission. In particular, it is possible to provide a stable electrical connection since a pair of the adjacent contacts is holding the terminal of the electronic component from both sides. Also, there is reduced possibility of damaging either the electronic component terminal or the contacts themselves.

The connector of the present invention also includes an actuator for adjusting the distance between the free ends of the at least one pair of adjacent contacts. The actuator includes two slat members, arranged one on top of the other having holes through which the free ends of the at least one pair of the adjacent contacts are positioned. Contacting walls of the holes of the two slat members contact so as to push apart the free ends of the at least one pair of adjacent contacts when the two slat members are pushed in opposite directions. The present invention enables the connector to connect to and disconnect from the electronic device terminal with little force, thus protecting the contacts.

In addition, the free ends of the at least one pair of adjacent contacts are circular-arc shaped and slightly shifted high and low with respect to each other. Likewise, the contacting walls of the holes of the slat members are circular-arc shaped. Since the apex of the arc of the free ends of the at least one pair of contacts is aligned with the apex of the arc of the contacting walls of the slat members, force is applied only in a horizontal direction to the circular-arc-shaped free ends when the actuator is pressed. In short, the force is applied only in the slidable directions of the slat members. As the force is not applied in a vertical direction so as to increase the friction force between the two slat members, it is possible to operate the actuator smoothly.

When the at least one pair of the adjacent contacts is made up of an earth contact and a signal contact, it is possible to arrange electronic device terminals close to one another and thus realize high-density mounting of electronic devices for rapid signal transmission.

When the at least one pair of adjacent contacts is made up of a pair of parallel signal contacts, the influence of noise can be reduced and it is possible to arrange electronic device terminals close to one another and thus realize a more preferable high-density mounting of electronic devices for rapid signal transmission.

An electronic component related to the present invention is connectable to the connector described in the present invention. The component includes a triple-layered terminal formed of a pair of terminals with insulating material therebetween.

BRIEF DESCRIPTION OF THE DRAWINGS

FIG. 4A through FIG. 4C describe the function of the connector of the embodiment of the present invention, wherein FIG. 4A shows a condition before operating the connector; FIG. 4B shows a condition while pressing an actuator and inserting a terminal of a substrate; and FIG. 4C shows a condition in which the connector is connected to the terminal when finishing an operation of the actuator;

FIG. 5A through FIG. 5D explain a method of manufacturing the substrate terminal of the embodiment of the present invention, wherein FIG. 5A shows a state in which insulating material is arranged on a patterned substrate; FIG. 5B shows a state in which the patterned substrate covered by a mask; FIG. 5C shows a state in which the terminal is being manufactured; and FIG. 5D shows a completed terminal after removing the mask.

DESCRIPTION OF THE PREFERRED EMBODIMENTS

A description will now be given, with reference to figures provided, of a connector and an electronic component of an embodiments of the present invention.

Figure 1:
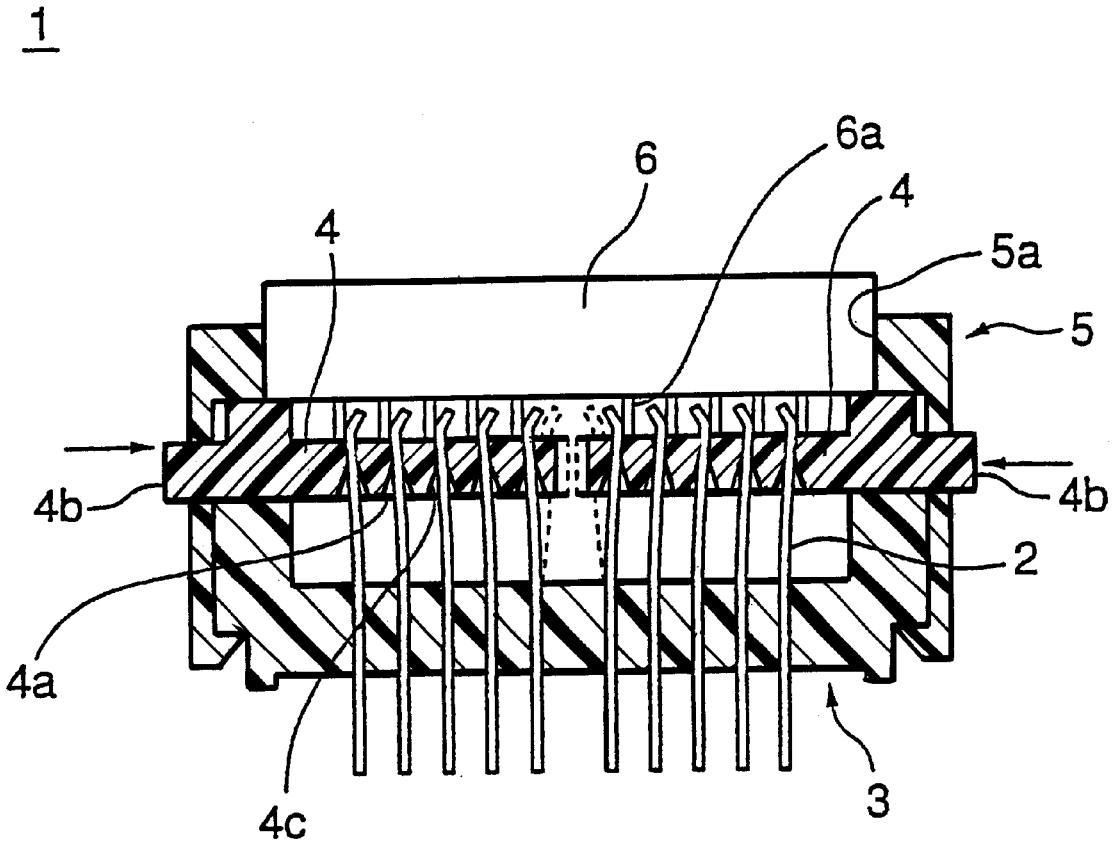
FIG. 1 PRIOR ART
FIG. 1 shows a cross section of a conventional connector.
Figure 2:
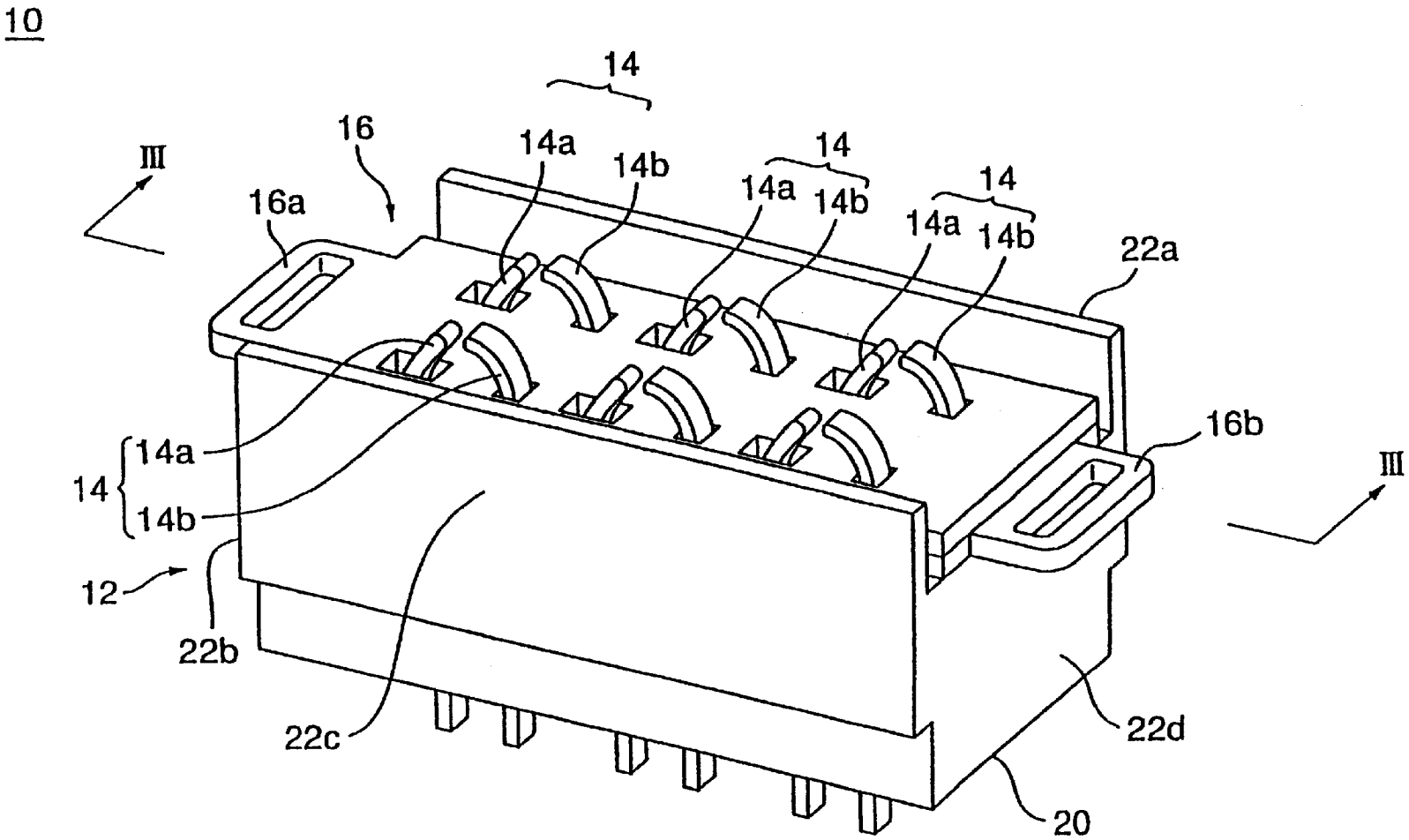
FIG. 2 is a perspective diagram of a connector of an embodiment of the present invention.
Figure 3:
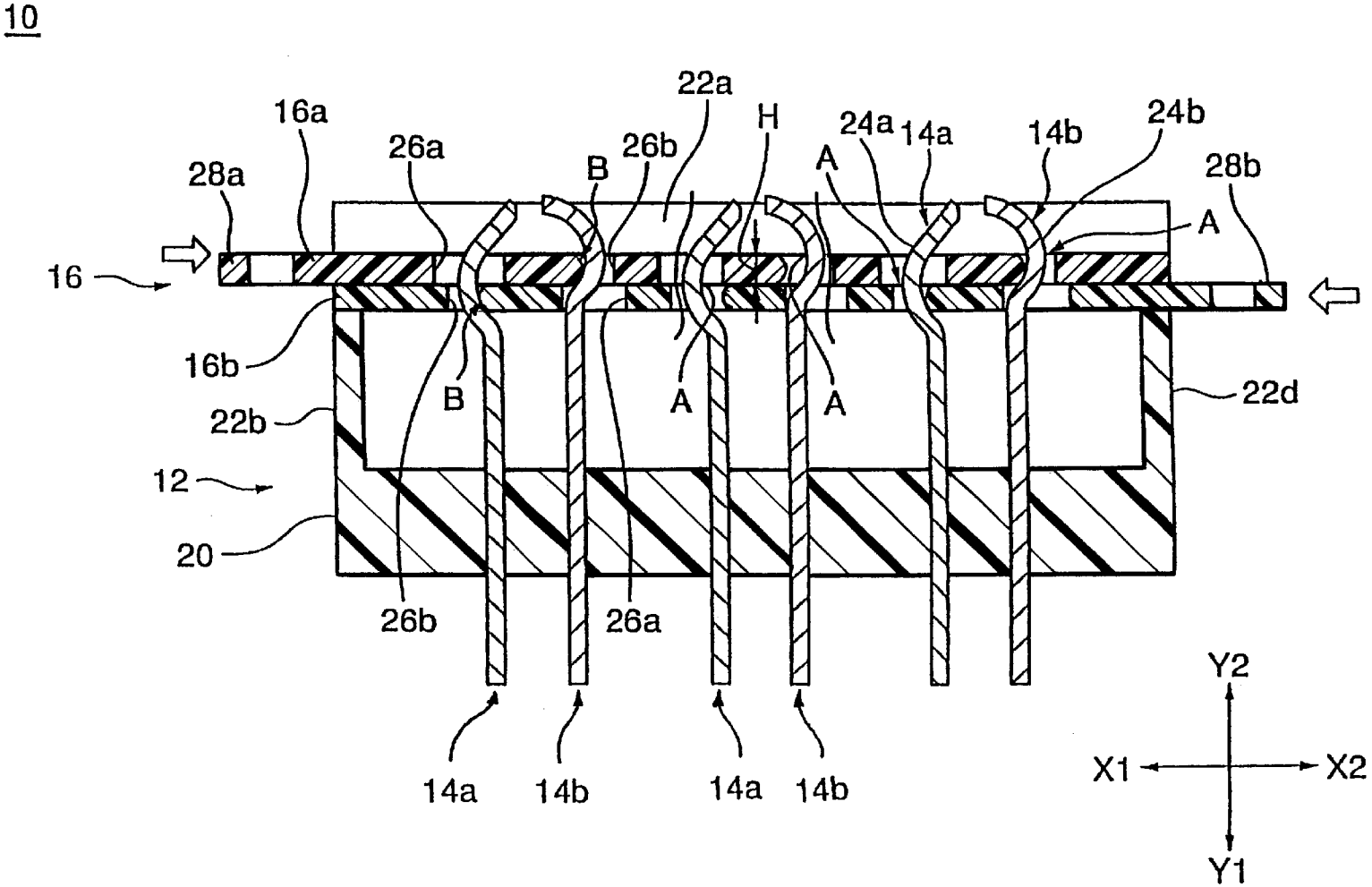
FIG. 3 shows a cross section of the connector of FIG. 2 taken along a III—III line.

FIG. 2 is a perspective diagram and FIG. 3 shows a cross section of a connector 10 of the present invention.

The connector 10 includes a case 12, contacts 14 and an actuator 16.

The case 12 is made of an insulating material and has a base 20 and four walls, 22*a* to 22*d*, extending from the base 20. Two of the walls facing each other, 22*a* and 22*c*, extend further upwards than the other two walls and form a guide section (mentioned hereinafter as 22*a* and 22*c*).

The base 20 supports three pairs of the contacts 14, where each contact 14 comprises a contact 14*a* and a contact 14*b*. As shown in FIG. 2, the contacts 14 are arranged in two rows. Each set of contacts 14*a* and 14*b* of each contact 14 have respective circular-arc-shaped free ends 24*b* and 24*a*, which are arranged in facing positions slightly shifted to relatively higher and lower positions, respectively. In addition, the contacts 14*a* and 14*b* are electrically isolated, or insulated, from each other by the base 20.

The slat members 16*a* and 16*b* each includes contact holes 26*a* surrounded by four flat walls and contact holes 26*b* of which one of the walls B in the X1–X2 direction indicated in FIG. 3 is circular-arc-shaped. The contact holes 26*a* and 26*b* are arranged with a certain pitch. In addition, the contact hole 26*a* of one of the slat members 16*a*, 16*b* and the contact hole 26*b* of the other one of the slat members 16*a*, 16*b* are paired up so as to communicate with each other. The circular-arc-shaped free ends 24*a* and 24*b* of the respective contacts 14*a* and 14*b* are arranged to pass through the corresponding pair of respective contact holes 26*a*, 26*b*.

On the X1-end of the slat member 16*a*is an operating portion 28*a*. Likewise, on the X2-end of the slat member 16*b* is an operation portion 28*b*. When both operating portions 28*a* and 28*b* are pressed in the directions indicated by the respective, adjacent arrows in FIG. 3, the circular-arc-shaped wall B of the contact hole 26*b* of the slat member 16*b*, pushes the top B in the X1 direction. On the other hand, the contact hole 26*a* of the slat member 16*b* pushes a portion A of the contact 14*a* in the X1 direction. At the same time, the circular-arc-shaped wall B of the contact hole 26*b* of the slat member 16*a* pushes the portion A of the contact 14*b* in the X2 direction. As a result, the circular-arc-shaped free ends 24 of each pair of contacts 14*a* and 14*b* are moved further apart from each other.

A description of the operation of the connector 10 will now be given with reference to FIG. 4A to FIG.4C.

Figure 4A:
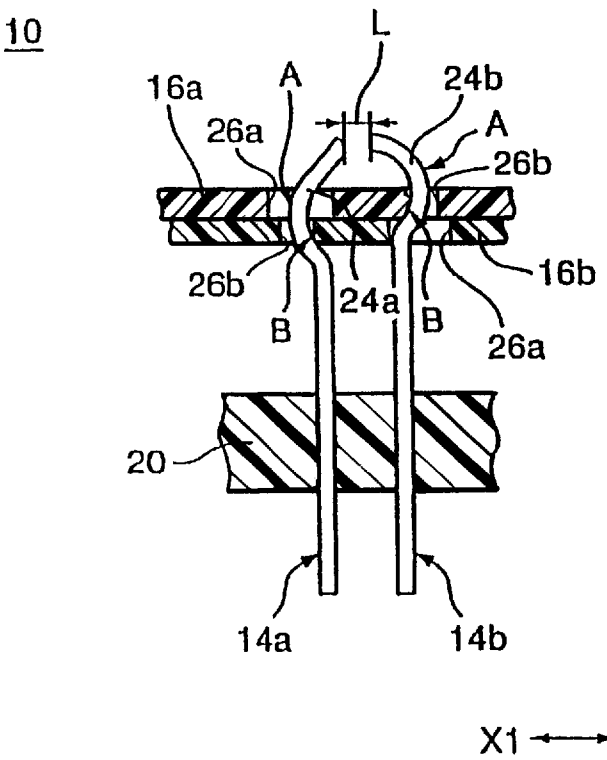

FIG. 4A shows a ("rest") condition before operating the connector 10 in correspondence to FIG. 3. Since the slat members 16*a* and 16*b* are not pushed towards each other, the contacts 14*a* and 14*b* stand upright. In this condition, tips 24*a* and 24*b* of the contacts 14*a* and 14*b*, respectively, are separated by a distance L.

Figure 4B:
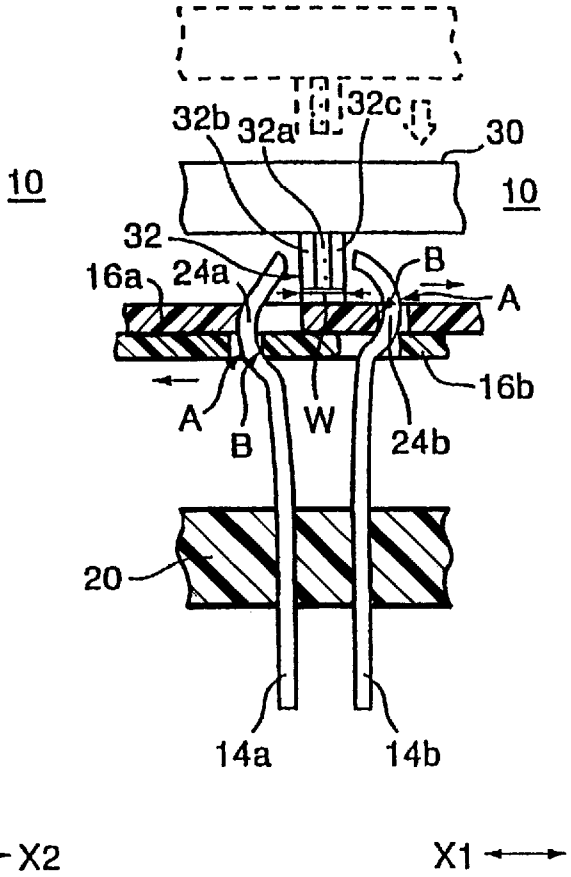

In FIG. 4B, a reference number 30 indicates a substrate of an electronic component related to the embodiment of the present invention, and a reference number 32 indicates a terminal attached to the substrate 30. The terminal 32 is a triple-layered terminal made up of insulating material 32*a* held between a pair of terminals 32*b* and 32*c*. The width W of the terminal 32 is sufficiently wider than the length L between the tips of the contacts 14*a* and 14*b*.

As indicated in FIG. 4B, the operating portions 28*a* and 28*b* are pressed by a compressive force, causing the slat member 16*a* to slide in the X2 direction and the slat member 16*b* to slide in the X1 direction. By doing so, the portion A of the contact 14*b* is pushed in the X2 direction by the wall B of the contact hole 26*b* of the slat member 16*a*. On the other hand, the portion A of the contact 14*a* is pushed in the X1 direction by the wall B of the contact hole 26*b* of the slat member. As a result, the free ends 24*a* and 24*b* of the contacts 14*a* and 14*b*, respectively, are pushed to an actuated condition, further apart than the width W of the terminal 32. In this actuated condition, the terminal 32 of the substrate 30 is inserted between the free ends 24 of the contacts 14*a* and 14*b*, so that the terminal 32*b* faces the contact 14*a* and the terminal 32*c* faces the contact 14*b*.

Figure 4C:
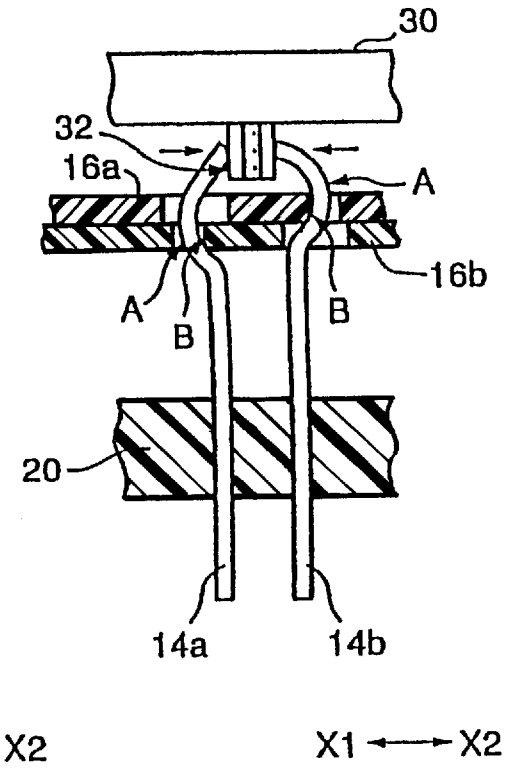

When the pressure applied to the operating portions 28*a* and 28*b* is slowly released, as indicated in FIG. 4C, the portions A of the contacts 14*a* and 14*b* push against the walls B of the contact holes 26*b*. As a result, the contacts 14*a* and 14*b* move closer together. The contacts 14*a* and 14*b* try to resume the separation length L, which is shorter than the width W. Therefore, there is enough pressure to hold the terminal 32, and thus the electronic component and the connector 10 are securely electrically connected.

One example of a manufacturing method of the terminal 32 of the substrate 30 will now be described with reference to FIG. 5A to FIG. 5D.

Figure 5B:
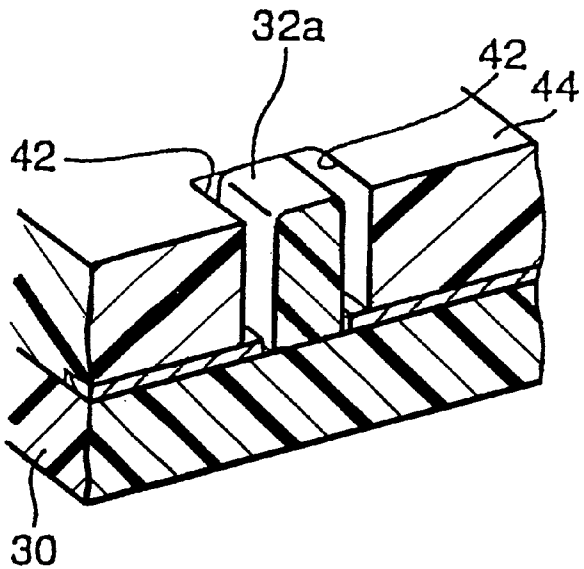
Figure 5A:
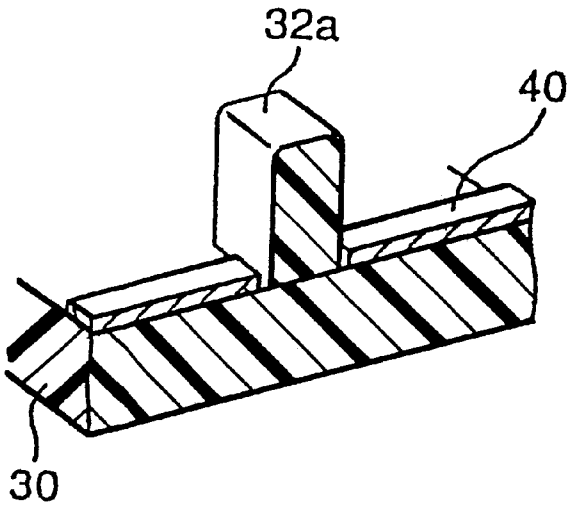

The insulating material 32*a* is placed, using an appropriate method, on top of the substrate 30. Next, a pattern 40 is formed on the substrate 30. (FIG. 5A)

The substrate 30 is covered with a mask 44 except for a certain space 42 on both sides of the insulating material 32*a*. (FIG. 5B)

Then, the terminals 32*b* and 32*c* are formed in the space 42 so as to connect to the pattern 40. (FIG. 5C)

Figure 5D:
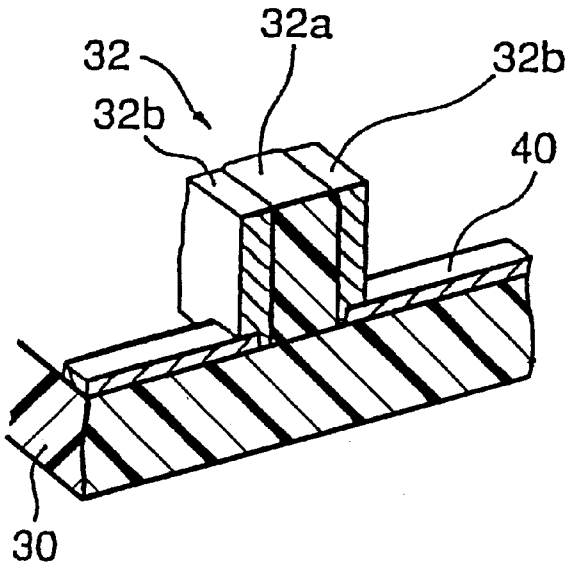
Figure 5C:
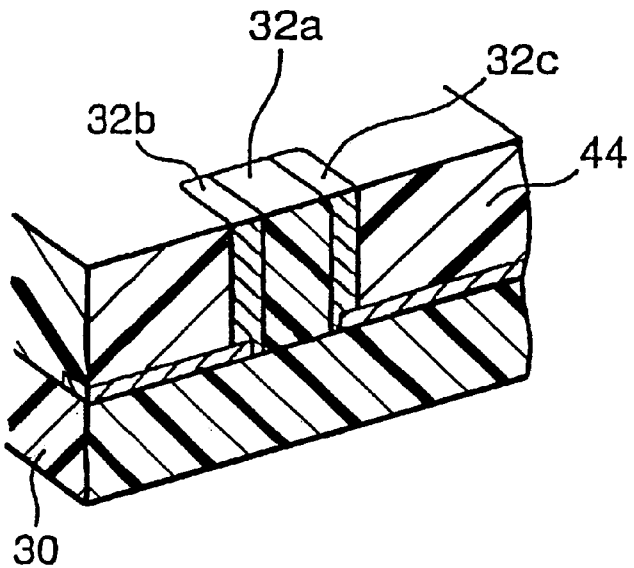

The triple-layered terminal 32 with the insulating material 32*a* held between the pair of terminals 32*b* and 32*c* is manufactured by removing the mask 44 (FIG. 5D).

With the above-described embodiment of the present invention related to the connector 10 and the substrate 30, it is possible to realize a more efficient high-density mounting of an electronic device for the rapid signal transmission. Particularly, since a pair of contacts 14*a* and 14*b* holds the terminal 32 of the substrate 30 from both sides, it is possible to secure the electrical connection, and there is a reduced possibility of damaging the terminal 32 or the contacts 14*a* and 14*b* themselves. In addition, by pressing the actuator 16, it is possible to connect the connector 10 to the terminal 32 of the substrate 30 with little force of installing and removing, and damage to the terminal 32 or the contacts 14*a* and 14*b* themselves is securely prevented.

Figure 6:
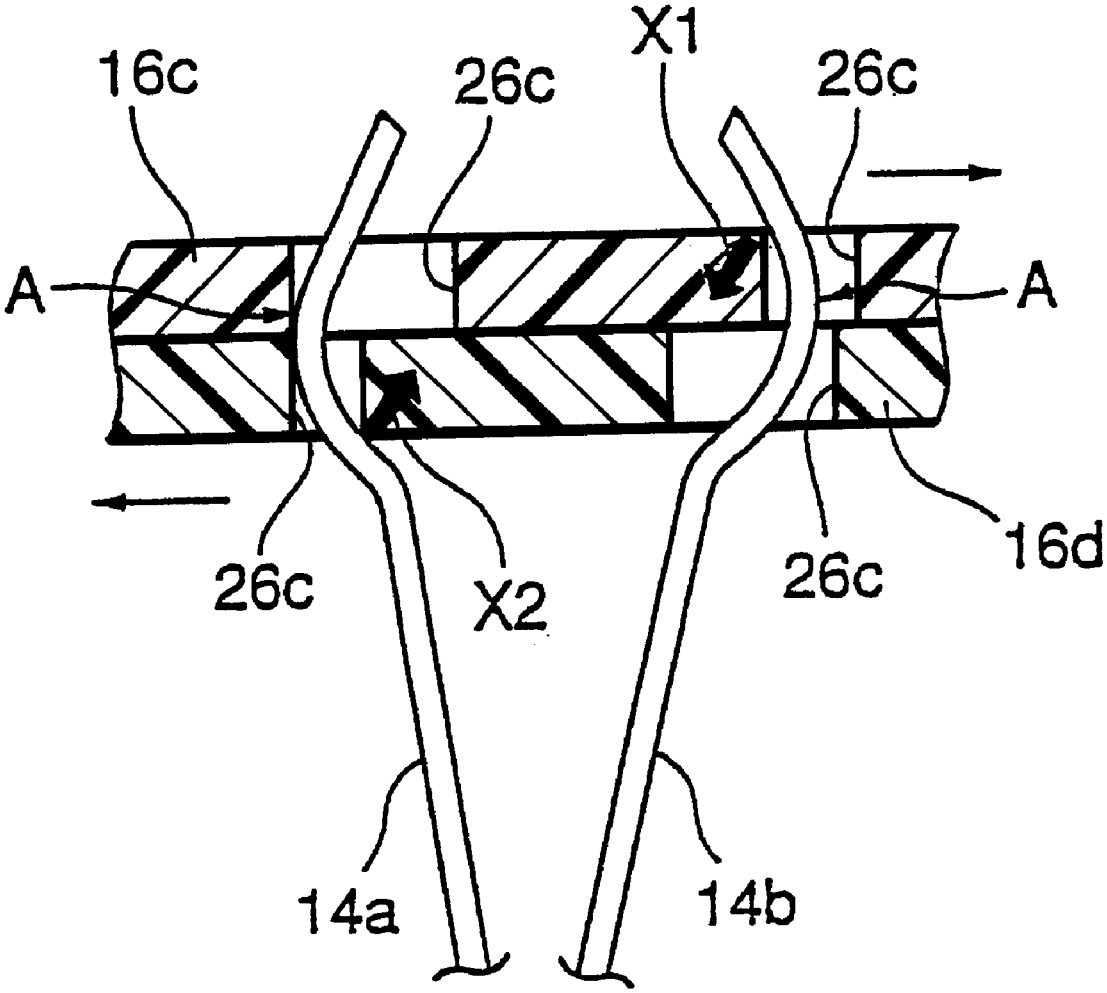
FIG. 6 is a supplementary explanation of a function of the connector of the embodiment of the present invention.

FIG. 6 is a comparative example of the connector 10. As indicated in FIG. 6, if all the walls of the contact holes 26*c* are flat evenly, and also if the top of the free ends of the contacts 14*a* and 14*b* are curved, when the actuator 16 is pressed, a force is added in a diagonal direction, as indicated by the arrow X1 in FIG. 6, to the slat member 16*c* and a force is added in a diagonal direction, as indicated by the arrow X2 in FIG. 6, to the slat members 16*d*. As a result, the slat members 16*c* and 16*d* experience an increased frictional force which prevents the actuator 16 from functioning smoothly in the horizontal direction, as shown in FIG. 6. On the other hand, with the connector 10 as indicated in FIG. 4B, force is only applied horizontally to the slat members 16*a* and 16*b*. Therefore, it is possible to operate the actuator 16 smoothly.

The pair of the contacts 14*a* and 14*b* of the connector 10 related to the above-described embodiment of the present invention can be combined together and considered as a single contact 14 that transmits signals. In addition, the pair of terminals 32*b* and 32*c* of the substrate 30 can be considered as a single terminal 32 that transmits signals.

As another alternative of the above, it is possible to apply the pair of the contacts 14*a* and 14*b* as an earth contact and a signal contact, and in correspondence, apply the terminals 32*b* and 32*c* of the terminal 32 as an earth terminal and a signal terminal. In this case, it is possible to arrange electronic terminals close to one another and to realize a more efficient high-density mounting of an electronic device for rapid signal transmission.

As another alternative, it is possible to apply the contacts 14*a* and 14*b* as a pair of parallel signal contacts, and in correspondence, apply the terminals 32*b* and 32*c* as parallel terminals. In this case, the influence of noise can be reduced. Also it is possible to arrange the electronic terminals close to one another and thus to realize a more efficient high-density mounting of an electronic device for rapid signal transmission.

Also the substrate 30 related to the preferred embodiments of the present invention is able to reduce the inductance.

The present invention is not limited to the specifically disclosed embodiment, and variations and modifications may be made without departing from the scope of the present invention.

The present application is based on Japanese Priority Application No. 2000-011964 filed on Jan. 20, 2000, the entire contents of which are hereby incorporated by reference.

What is claimed is:

1. An electronic component connectable to a connector, wherein said electronic component comprises a triple-layered terminal formed of a pair of terminals holding an insulating material therebetween, and said connector comprises:

at least one pair of adjacent contacts having flexible free ends arranged so as to face each other; and an actuator adjusting a distance between said free ends of said at least one pair of adjacent contact, wherein said at least one pair of adjacent contacts holds the three-layered terminal of the electronic component from both sides so as to form an electrical connection, and wherein said actuator comprises two slat members, arranged one on top of the other, having holes through which said free ends of said at least one pair of adjacent contacts are positioned, wherein by sliding said two slat members in opposite directions, contacting walls of said holes of said two slat members contact so as to push apart said free ends of said at least one pair of adjacent contacts.

2. A connector connectable to an electronic component, said connector comprising:

at least one pair of adjacent contact having flexible free ends arranged so as to face each other; and an actuator adjusting a distance between said free ends of said at least one pair of adjacent contacts, wherein said at least one pair of adjacent contacts holds a terminal of the electronic component from both sides so as to form an electrical connection, and wherein said actuator comprises two slat members, arranged one on top of the other, having holes through which said free ends of said at least one pair of adjacent contacts are positioned, wherein by sliding said two slat members in opposite directions, contacting walls of said holes of said two slat members contact so as to push apart said free ends of said at least one pair of adjacent contacts.

3. The connector as claimed in claim 2, wherein:

said contacting walls of said holes of said two slat members are circular-arc shaped;

said free ends of said at least one pair of adjacent contacts are also circular-arc shaped and are arranged slightly shifted high and low with respect to each other; and an apex of the arc of said free ends of said pair of adjacent contacts is aligned with an apex of the arc of said contacting walls of said holes of said slat members.

4. The connector as claimed in claim 2, wherein said at least one pair of the adjacent contacts comprises a ground contact and a signal contact.

5. The connector as claimed in claim 2, wherein said at least one pair of adjacent contacts comprises a pair of parallel signal contacts.

6. A connector which resiliently engages a terminal, comprising:

a pair of first and second elongated contacts, each having a fixed end and extending in a first direction to a free end, the respective free ends of the first and second contacts being separated by a first distance in a rest condition and being resiliently displaceable to an actuated condition in which the free ends are separated by a second distance, greater than the first distance; and an actuator disposed about each of the first and second elongated contacts adjacent the free ends thereof and extending in a second direction, transverse to the first direction, and comprising first and second actuator operating parts responsive to compressive forces thereon to selectively apply deflection forces to the second and first elongated contacts, respectively, and thereby resiliently displace the free ends thereof to the actuated condition to receive therebetween a terminal to be resiliently engaged by the free ends upon release of the compressive force.

7. A connector as recited in claim 6, wherein:

the actuator comprises first and second substantially planar actuator elements extending in the second direction in superposed and sliding relationship, each of the first and second actuator elements having holes therein aligned with and receiving therein the free ends of each of the first and second contacts, the first actuator element having a larger hole aligned with the free end of the first elongated contact and a smaller hole aligned with the free end of the second elongated contact and the second actuator element having a smaller hole aligned with the free end of the first elongated contact, and a larger hole aligned with the free end of the second elongated contact, the compressive forces applied to the first and second actuator operating parts producing oppositely oriented, relative sliding movements of the first and second actuator elements in the second direction, sidewalls of the smaller holes engaging the respective free ends of the first and second actuator elements and applying the deflecting forces thereto, to deflect same to the actuated condition, and the sidewalls of the larger holes permitting deflection of the respective free ends received therein.

8. The connector as claimed in claim 7, wherein:

said contacting sidewalls of the smaller holes of said planar actuator elements are circular-arc shaped;

the free ends of the pair of first and second adjacent elongated contacts are also circular-arc shaped and are shifted so as to be high and low with respect to each other in the first direction; and an apex of the arc of the free ends of the pair of first and second contacts is aligned with an apex of the arc of the contacting sidewalls of the smaller holes of the actuator elements.

9. A connector as recited in claim 6, further comprising;

plural pairs of first and second elongated contacts;

the actuator being disposed about each of the elongated contacts of the plurality of pairs thereof, adjacent the respective free ends thereof, the first and second actuator operating parts being relatively closer to the second and first elongated contacts, respectively, of each of the plural pairs thereof and being responsive to compressive forces thereon to selectively apply the deflection forces to the second and first elongated contacts, respectively, of each of the plural pairs thereof, and thereby resiliently displacing the respective free ends of the plural pairs of elongated contacts in common to respective actuated conditions thereof and thereby to receive respectively therebetween plural terminals to be resiliently engaged by the respective free ends of the plural pairs of first and second elongated contacts upon the release of the compressive force.

10. A connector as recited in claim 9, wherein:

the actuator comprises first and second substantially planar actuator elements extending in the second direction in superposed and sliding relationship, each of the first and second actuator elements having holes therein aligned with and receiving therein the free ends of each of the first and second contacts, the first actuator element having larger holes aligned with respective free ends of the first elongated contacts and smaller holes aligned with respective free ends of the second elongated contacts and the second actuator element having smaller holes aligned with respective free ends of the first elongated contacts and larger holes aligned with respective free ends of the second elongated contacts, the compressive force applied to the first and second actuator operating parts producing oppositely oriented relative sliding movements of the first and second actuator elements in the second direction, sidewalls of the smaller holes engaging the respective free ends of the first and second actuator elements and applying the deflecting forces thereto, to deflect same to the actuated condition, and the sidewalls of the larger holes permitting deflection of the respective free ends received therein.

11. The connector as claimed in claim 10, wherein at least one pair of the plural pairs of first and second elongated contacts comprises a ground contact and a signal contact, respectively.

12. The connector as claimed in claim 10, wherein the at least one pair of first and second elongated contacts comprises a pair of parallel signal contacts.

* * * * *